US006311975B1

(12) United States Patent
Motosko

(10) Patent No.: US 6,311,975 B1
(45) Date of Patent: Nov. 6, 2001

(54) COMBINATION TWO PLAYER PINBALL MACHINE AND REMOTE CONTROL THEREFOR

(76) Inventor: Stephen J. Motosko, 132 Sand Dollar La., Sarasota, FL (US) 34242

( * ) Notice: Subject to any disclaimer, the term of this patent is extended or adjusted under 35 U.S.C. 154(b) by 0 days.

(21) Appl. No.: 09/605,505

(22) Filed: Jun. 28, 2000

(51) Int. Cl.[7] ..... A63F 7/22

(52) U.S. Cl. ..... 273/121 A; 463/3; 273/118 A; 273/119 A

(58) Field of Search ..... 273/118 R, 118 A, 273/118 D, 119 R, 119 A, 121 R, 121 A; 463/3

(56) References Cited

U.S. PATENT DOCUMENTS

| | | | | |
|---|---|---|---|---|
| 3,675,927 | * | 7/1972 | Gottlieb et al. | 273/119 A |
| 4,986,543 | * | 1/1991 | Heller | 273/121 A |
| 4,991,845 | * | 2/1991 | Wies | 273/121 A |
| 5,064,196 | * | 11/1991 | Gottlieb | 273/121 A |
| 5,131,654 | * | 7/1992 | Gottlieb et al. | 273/121 A |
| 5,238,248 | * | 8/1993 | Gottlieb | 273/121 A |
| 5,324,034 | * | 6/1994 | Gottlieb | 273/121 R |
| 5,330,183 | * | 7/1994 | Gottlieb | 273/121 R |
| 5,797,795 | * | 8/1998 | Takemoto et al. | 463/42 |
| 5,890,715 | * | 4/1999 | Gomez et al. | 273/118 A |

* cited by examiner

*Primary Examiner*—Raleigh W. Chiu
(74) *Attorney, Agent, or Firm*—Charles J. Prescott

(57) ABSTRACT

A two-player pinball machine with a remote control unit for a second player. The invention includes a pinball machine having a play field including a plurality of spaced scoring bumpers and pinball striking members mounted on the play field. A pinball proper is operable by a first player for propelling a pinball onto said play field. Push buttons mounted on each side of the pinball machine operable by the first player are connected to each individual pinball striking member for selectively striking the pinball to maintain play. Each scoring bumper, when struck by the pinball, registering a score. A score redirecting arrangement includes a score control circuit of the pinball machine and a separate wireless remote control unit operable by a second player. The remote control unit includes a separate actuator button spacially arranged to correspond to each scoring bumper for electronically activating the score control circuit to redirect a crediting of each score made from the total score of the first player to the total score of the second player when, in anticipation of the score to be made by the first player, the second player timely presses one the actuator buttons corresponding to the scoring bumper about to be struck by the pinball within a very short period of time immediately prior to pinball impact thereof.

2 Claims, 4 Drawing Sheets

COMBINATION TWO PLAYER PINBALL MACHINE AND REMOTE CONTROL THEREFOR

BACKGROUND OF THE INVENTION

1. Scope of Invention

This invention relates generally to conventional pinball machines, and particularly to the combination of an improved pinball machine and remote playerless control therefor enabling two players to simultaneously compete with one another during each pinball game.

2. Prior Art

Conventional pinball machines which are played by one player at a time are well known. Such machines have a slightly inclined play field and a metal ball which is projected to roll over the play field while, hopefully, striking various pinball striking and scoring members positioned thereon. When each scoring member is struck by the pinball, the particular score assigned to that particular scoring member is added to the total score of one player for each round of play onto an electronic scoreboard.

Each of these pinball striking members or flippers are manually actuated by the player to propel the pinball back into play for higher scoring. These non-scoring pinball striking members are also manually actuable to maintain the pinball in play for extended scoring opportunities. However, applicant is unaware of any improvement in pinball machines which would allow simultaneous competitive play between two players on the same pinball machine.

BRIEF SUMMARY OF THE INVENTION

This invention is directed to a two-player pinball machine with a remote control unit for a second player. The invention includes a pinball machine having a play field including a plurality of spaced scoring bumpers and pinball striking members mounted on the play field. A pinball proper is operable by a first player for propelling a pinball onto said play field. Push buttons mounted on each side of the pinball machine operable by the first player are connected to each individual pinball striking member for selectively striking the pinball to maintain play. Each scoring bumper, when struck by the pinball, registering a score. A score redirecting arrangement includes a score control circuit of the pinball machine and a separate wireless remote control unit operable by a second player. The remote control unit includes a separate actuator button spacially arranged to correspond to each scoring bumper for electronically activating the score control circuit to redirect a crediting of each score made from the total score of the first player to the total score of the second player when, in anticipation of the score to be made by the first player, the second player timely presses one the actuator buttons corresponding to the scoring bumper about to be struck by the pinball within a very short period of time immediately prior to pinball impact thereof.

It is therefore a broad object of this invention to provide a combination two player pinball machine and remote control device which facilitates simultaneous two player competition during each pinball game sequence.

In accordance with this and other objects which will become apparent hereinafter, the instant invention will now be described with reference to the accompanying drawings.

DETAILED DESCRIPTION OF THE INVENTION

Figure 1:
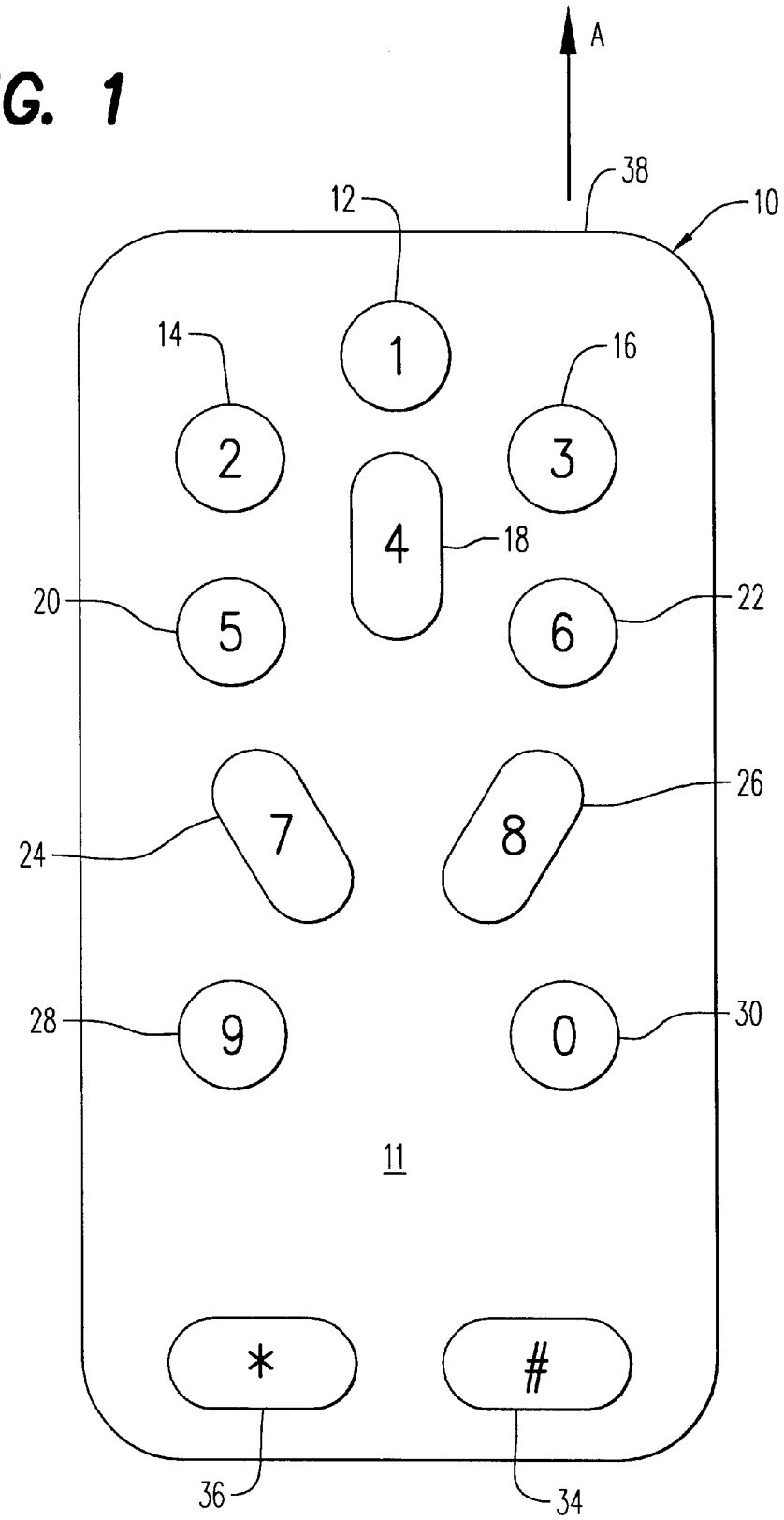
FIG. 1 is a top plan view of a hand-held wireless remote control unit of the invention.

Referring now to the drawings and firstly to FIG. 1, a wireless hand-held remote control unit is there shown generally at numeral 10. This remote control unit 10 includes a housing 11 enclosing infrared (IR) circuitry (not shown) for emitting an appropriate preselected IR control signal in the direction of arrow A from an opening 38 formed in the forward edge of the housing 11. Positioned on the obverse surface of the housing 11 is an array of separate actuator buttons 12, 14, 16, 18, 20, 22, 24, 26, 28 and 30 numbered zero to nine. Each of the actuator buttons, when pressed, causes a preselected IR signal to be emitted which activates a particular function of scoring circuitry within a pinball machine shown generally at numeral 40 in FIG. 2, the circuit details of which are described herebelow and in FIG. 3. Two additional actuator buttons 34 and 36 are also provided to activate ancillary functions within the scoring circuit of the pinball machine 40 such as an on/off signal and a signal to activate a separate alarm for detecting motion around the pinball machine 40 when not in use.

Figure 2:
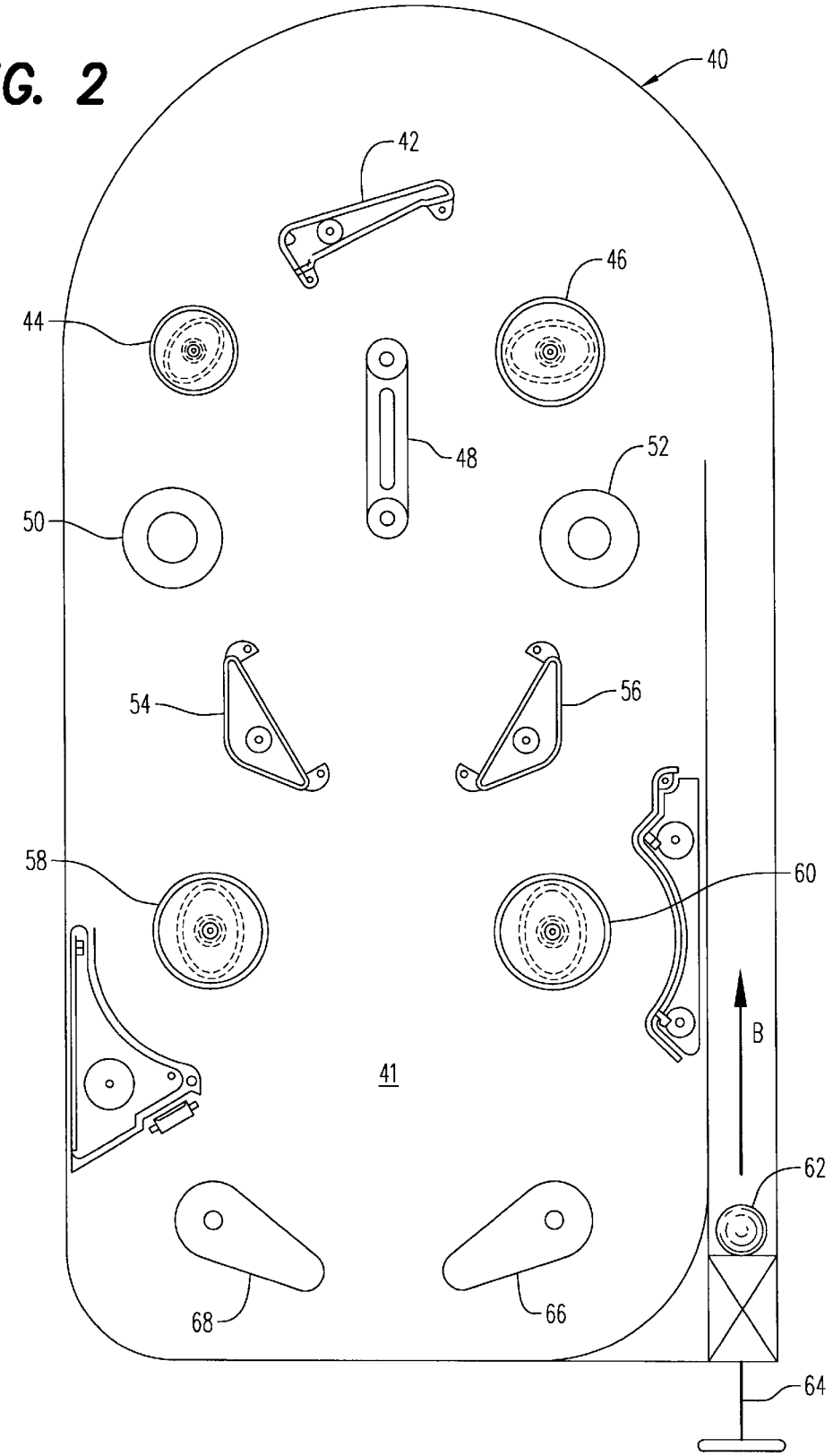
FIG. 2 is a top plan view of a pinball machine and play field having pinball striking flippers and scoring members corresponding in overall spacial layout to that of the hand held remote control unit actuator button layout of FIG. 1.

In FIG. 2, the pinball machine includes a play field 41 which is generally of a conventional well-known nature in the pinball art except with respect to a specific placement of scoring members described herebelow. A pinball 62 is launched in the direction of arrow B onto the play field 41 by pulling and releasing spring actuator 64. Manual control of flippers 66 and 68 are provided by manually depressing buttons (not shown) on either side of the pinball machine 40. An array of scoring bumpers 42, 44, 46, 48, 50, 52, 54, 56, 58, and 60 are arranged on the play field 41, each scoring bumper registering a score on a scoreboard (not shown) of the pinball machine 40 in a preselected scoring amount. Typically, the scoring bumpers 42, 44, 46, 48, 50, 52, 54, 56, 58, and 60 each also cause the pinball 62 to be accelerated away from the scoring bumper as it is struck to maintain play.

The essence of the uniqueness of this invention resides in a second player utilizing the separate hand-held remote control unit 10 to selectively activate one or more of the separate actuator buttons 12, 14, 16, 18, 20, 22, 24, 26, 28 and 30 on a momentary timely basis within a very short period of time, e.g. one second, immediately prior to the pinball 62 striking the corresponding scoring bumper, e.g. actuator button 16 for scoring bumper 46. If timely done within this momentary time period prior to pinball striking, the score is credited to the total score of the second player operating the remote control unit 10 rather than to the total score of the first player who is operating the pinball machine 40 itself.

To assist in increasing the likelihood that the second player will timely activate circuitry within the pinball machine 40 shown in FIG. 3 described herebelow to "steal" the score from the first player, each of the actuator buttons 12, 14, 16, 18, 20, 22, 24, 26, 28 and 30 are arranged in substantially the same spacial arrangement as that of the scoring bumpers 42, 44, 46, 48, 50, 52, 54, 56, 58, and 60 on the pinball play field 41.

Therefore, the first player at the pinball machine 40 will receive a predetermined score added to his or her total score each time the pinball 62 strikes one of the scoring bumpers 42, 44, 46, 48, 50, 52, 54, 56, 58, or 60 on the play field 41 unless the second player, holding the remote control unit 10, timely activates the separate additional scoring shown in FIG. 3 circuit associated with the precise scoring bumper of the array of scoring bumpers 42, 44, 46, 48, 50, 52, 54, 56, 58, and 60 just prior to pinball 62 impact thereof. If the second player is too slow or too premature in activating the scoring transfer circuit of the particular scoring bumper about to be struck by the pinball 62, the first player gets the score added to his or her total score.

Figure 3A:
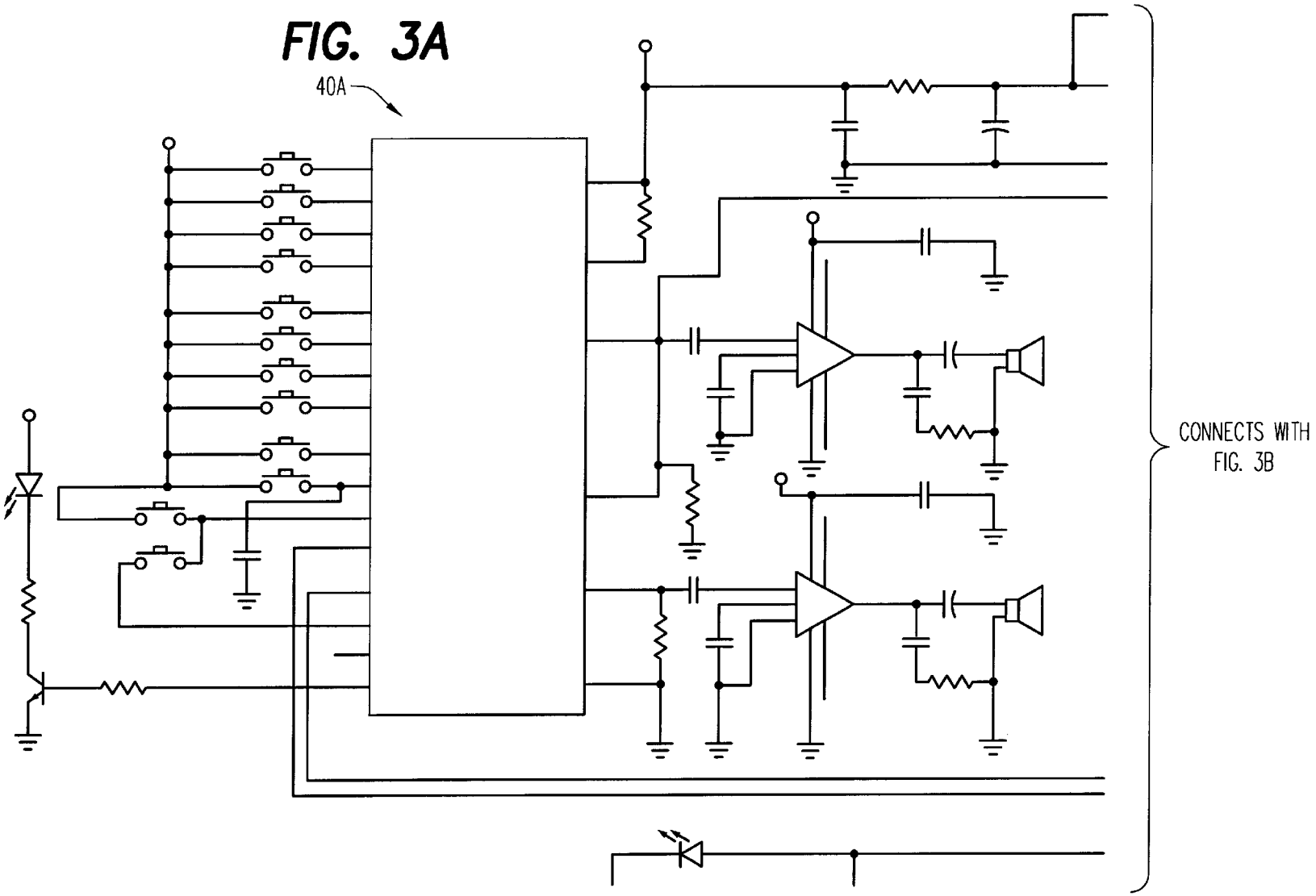
FIGS. 3A and 3B are electrical schematic view of the scoring member control circuit within the pinball machine.
Figure 3B:
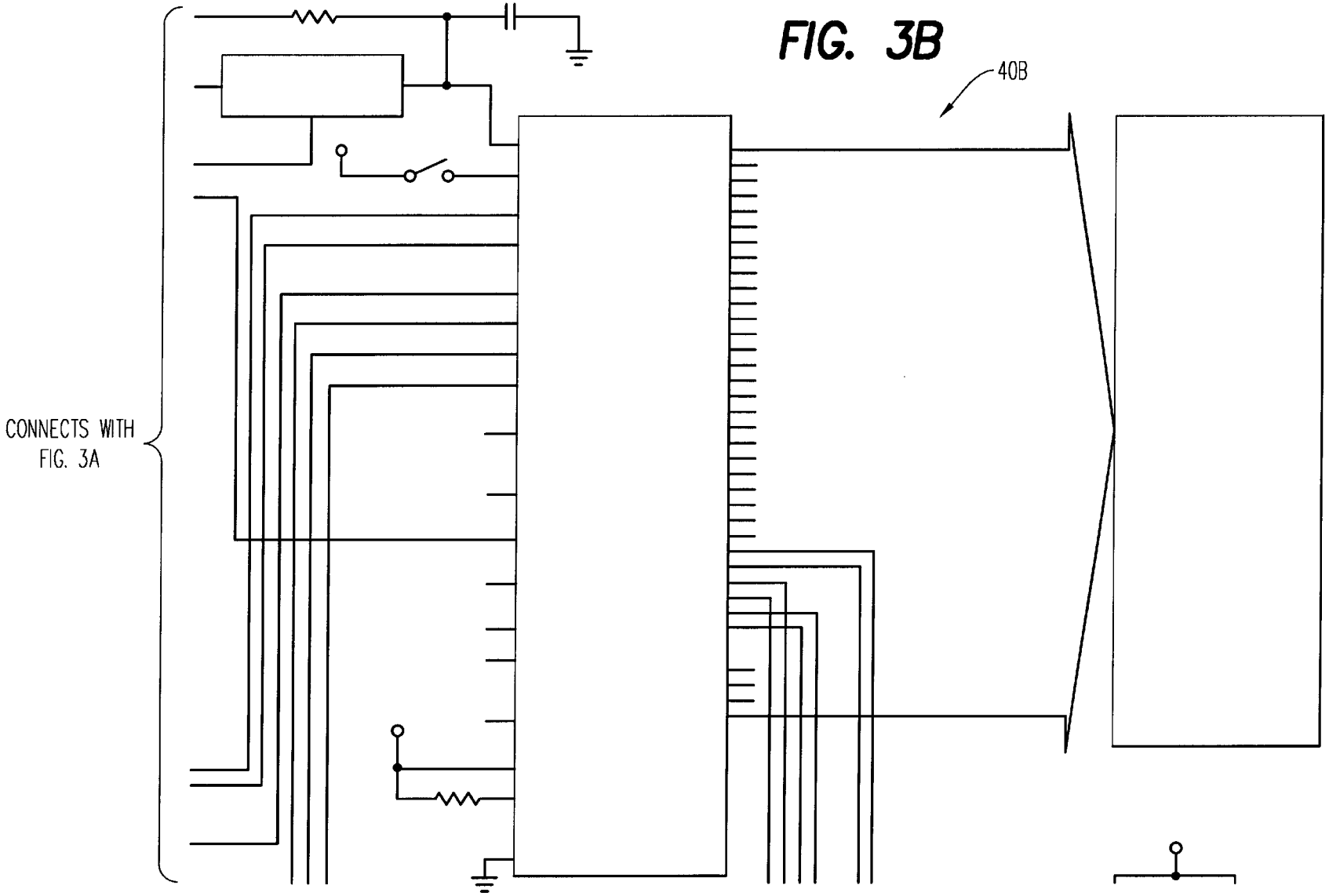

Referring now to FIGS. 3A and 3B, a detailed circuit diagram contained within the pinball machine 40A and 40B is there shown and is of an otherwise conventional design to implement the functioning of this invention as above described.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A combination two-player pinball machine and remote control comprising:

a pinball machine having a play field including a plurality of spaced scoring bumpers and pinball striking members mounted on said play field;

a pinball propelling means operable by a first player for propelling a pinball onto said play field to contact said scoring bumpers;

means operable by said first player and connected to each individual said pinball striking member for selectively striking said pinball to maintain play;

each said scoring bumper, when struck by said pinball, registering a score;

a score redirecting means including a score control circuit of said pinball machine and a separate wireless remote control unit operable by a second player having separate actuator button spacially arranged to correspond to each said scoring bumper for electronically activating said score control circuit to redirect a crediting of each score made from the total score of said first player to the total score of said second player when, in anticipation of the score to be made by said first player, said second player timely presses one said actuator button corresponding to one said scoring bumper about to be struck by said pinball within a very short period of time immediately prior to pinball impact thereof.

2. A two-player pinball machine with a separate remote control unit operable by a second player comprising:

a pinball machine having a play field including a plurality of spaced scoring bumpers and pinball striking members mounted on said play field;

a pinball propelling mechanism operable by a first player to start each game by propelling a pinball onto said play field to contact said scoring bumpers;

control buttons mounted on said pinball machine operable by said first player and operably connected to each individual said pinball striking member for selectively striking said pinball to maintain play;

each said scoring bumper, when struck by said pinball, registering a score;

a score redirecting arrangement including a score control circuit of said pinball machine and said remote control unit operable by the second player having separate actuator button spacially arranged to correspond to each said scoring bumper for electronically activating said score control circuit to redirect a crediting of each score made from the total score of said first player to the total score of said second player when, in anticipation of the score to be made by said first player, said second player timely presses one said actuator button corresponding to one said scoring bumper about to be struck by said pinball within a very short period of time immediately prior to pinball impact thereof.

* * * * *